United States Patent [19]

Exley et al.

[11] Patent Number: 4,632,137

[45] Date of Patent: Dec. 30, 1986

[54] UMBRELLA HANDLE WITH SNAP-LOCKED, SUBSTANTIALLY CONCEALED CARRYING RING

[75] Inventors: Jyll Exley, Deptford, N.J.; Thiebault Bouet, New York, N.Y.

[73] Assignee: Yves Saint Laurent, Inc., New York, N.Y.

[21] Appl. No.: 663,441

[22] Filed: Oct. 22, 1984

[51] Int. Cl.[4] ..... A45B 11/00

[52] U.S. Cl. ..... 135/20 R

[58] Field of Search ..... 135/20 R, 33 R, 33 C, 135/34; 16/127; 362/202, 203, 207, 208

[56] References Cited

U.S. PATENT DOCUMENTS

| | | | |
|---|---|---|---|
| 868,326 | 10/1907 | Casale | 135/33 C |
| 1,591,980 | 7/1926 | Jones | 362/202 |
| 1,644,126 | 10/1927 | Harris | 362/202 |
| 1,977,086 | 10/1934 | Pryor | 362/208 |
| 2,249,690 | 7/1941 | Gelardin | 362/203 |
| 2,381,510 | 8/1945 | Muldoon | 16/127 |
| 2,838,058 | 6/1958 | Foltis et al. | 135/20 R |
| 3,785,388 | 1/1974 | Schafer | 135/20 R |
| 4,203,150 | 5/1980 | Shamlian | 362/202 |

*Primary Examiner*—James R. Feyrer

*Attorney, Agent, or Firm*—Cooper, Dunham, Griffin & Moran

[57] ABSTRACT

A convenient snap-fitting, pivotal ring is hingedly attached to the handle portion of the umbrella with abutting portions of the handle end preventing the ring from pivoting more than about 90°.

2 Claims, 10 Drawing Figures

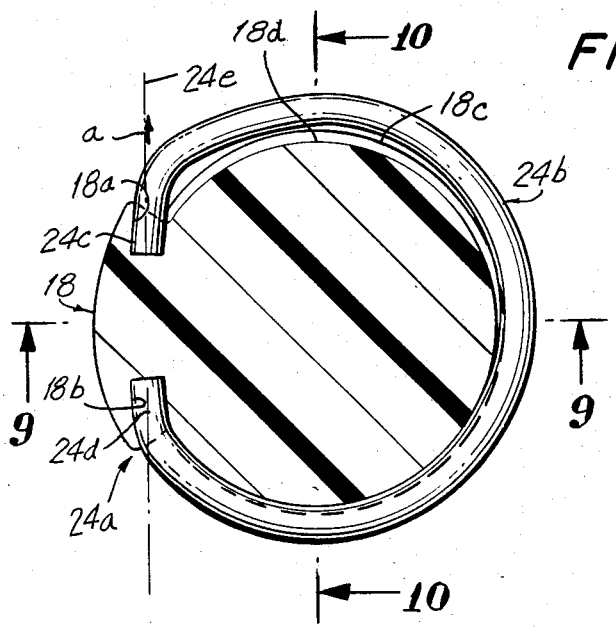
FIG. 8
FIG. 9
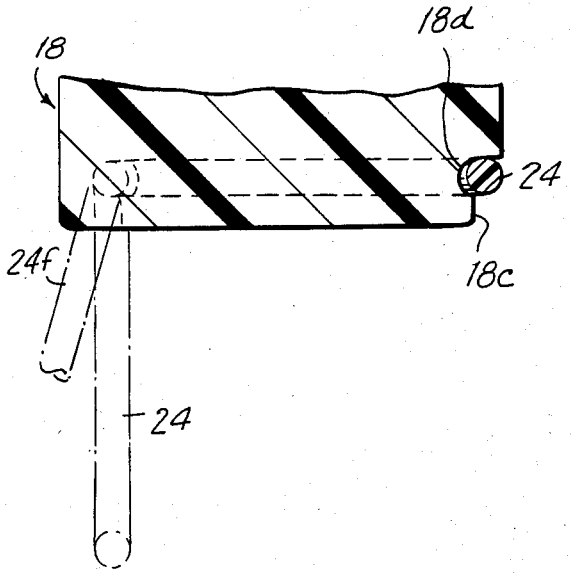
FIG. 10
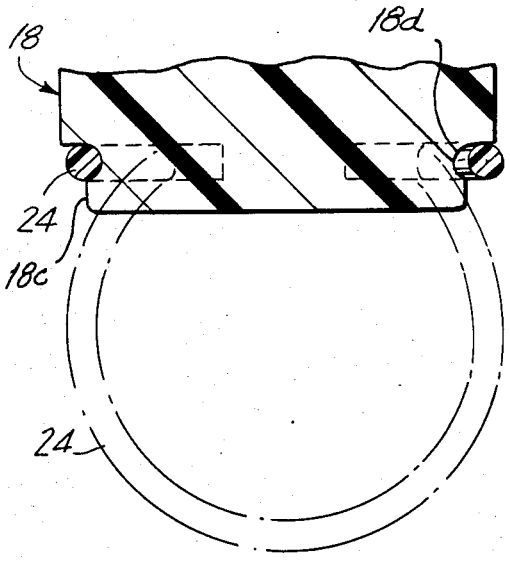

UMBRELLA HANDLE WITH SNAP-LOCKED, SUBSTANTIALLY CONCEALED CARRYING RING

BACKGROUND AND SUMMARY OF THE INVENTION

The invention is in the field of folding personal umbrellas and relates particularly to a handle with a carrying ring which is particularly practical while aesthetically pleasing in appearance.

While in some cases it is desirable to have an open carrying ring at the handle, so that the unbrella can be carried by or secured through the ring, in other cases it may be undesirable to have such an open ring. For example, it may not be comfortable to hold an unbrella with an open carrying ring or such a ring may not present an aesthetically pleasing appearance. A ring which simply pivots between open and closed positions may be helpful, but in order to be practical it must be easy to use, present an aesthetically pleasing appearance, give reliable operation and be easy to manufacture, assemble and use, and this invention is directed to meeting those goals in a particularly advantageous way.

In an exemplary embodiment the invention comprises an umbrella with a handle having a C-shaped carrying ring which pivots between open and closed positions, snap-locks in the closed position, and is substantially concealed when closed but has a portion which extends just beyond the handle outline to facilitate snapping the ring away from its closed position. The handle is elongated and has a round sidewall, and the ring is pivotally secured at its bottom, with the pivot axis parallel to the bottom but offset from the handle axis and near a tangent to the handle circumference. In its closed position the ring is substantially coaxial with the handle and a substantial portion of the outside circumference of the ring arc is substantially flush with the handle sidewall. In the open position, the ring axis is at an angle to the handle axis which can range in absolute value from a few to about 90°. The pivotal connection of the ring to the handle is by means of a pair of oppositely facing wells in the handle which are coaxial with the ring pivot axis and are shaped and dimensioned to receive the free ends of the C-shaped ring such that they can rotate within the wells about the pivot axis as well as move within the wells along the pivot axes. When in its closed position, the ring is partially received within a circumferential groove near the bottom of the handle which is defined in part by a circumferential, radially extending flange at the handle bottom. When the ring is in its closed position, substantially less than its entire arc makes contact with the groove, and substantially less than its entire arc makes contact with the flange when the ring is being moved into or away from its closed position. A portion of the outside arc of the ring extends radially beyond the outline of the handle sidewall so as to provide a convenient surface which can be pushed down to unsnap the ring from its closed position and move it into its open position. The relative dimensions are such that convenient operation is possible while retaining the visual appearance that when closed the ring is substantially flush with the handle sidewall. The combination of convenient operation and desired visual appearance is achieved, in part, by shaping the ring such that one end of its arc is considerably farther from the groove than its other end when the ring is in the closed position.

BRIEF DESCRIPTION OF THE DRAWINGS

FIG. 8 is a sectional view taken along line 8—8 of FIG. 7.

FIG. 9 is a partial sectional view taken along line 9—9 of FIG. 8 and illustrating the ring both in its open position and in its closed position.

FIG. 10 is a similar sectional view along line 10—10 of FIG. 8.

DETAILED DESCRIPTION

Figure 1:
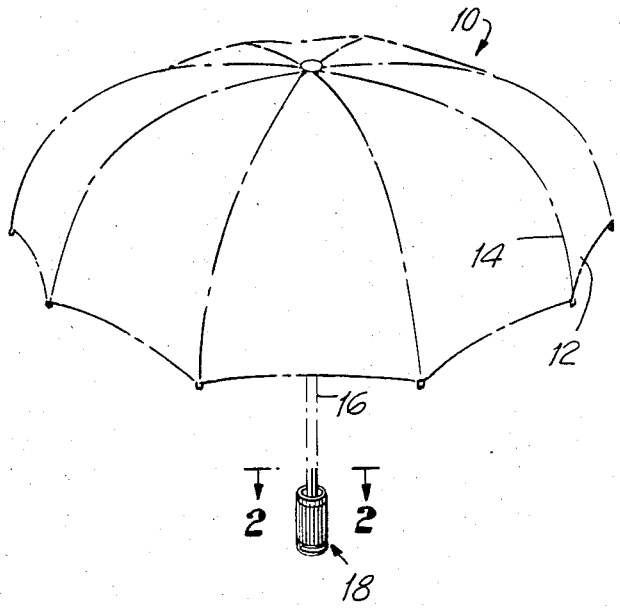
FIG. 1 is a perspective view of an unbrella with a handle which comprises an exemplary embodiment of the invention.
Figure 2:
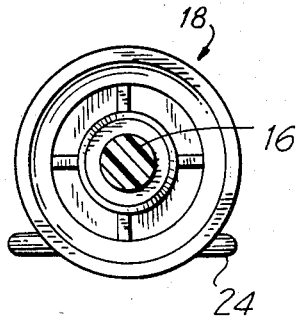
FIG. 2 is a sectional view taken along line 2—2 of FIG. 1.
Figure 3:
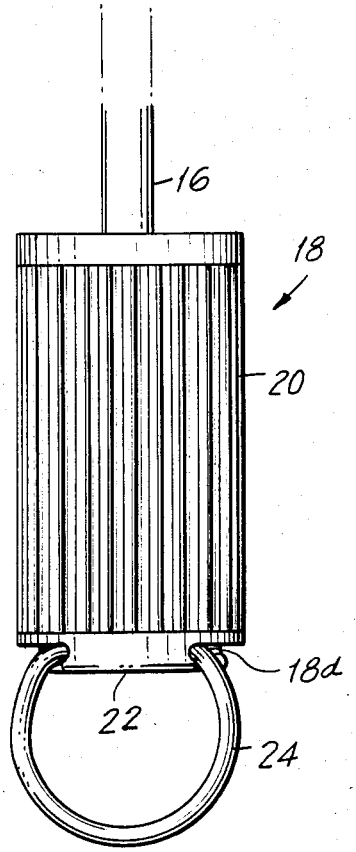
FIG. 3 is a back elevational view of the handle showing a carrying ring in its open position.
Figure 4:
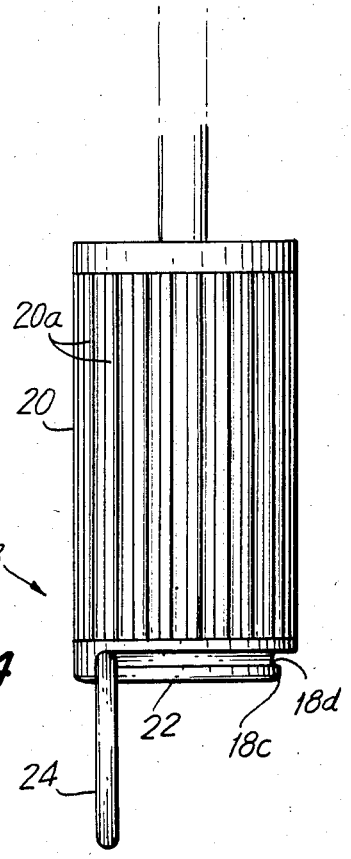
FIG. 4 is a side elevational view thereof.
Figure 5:
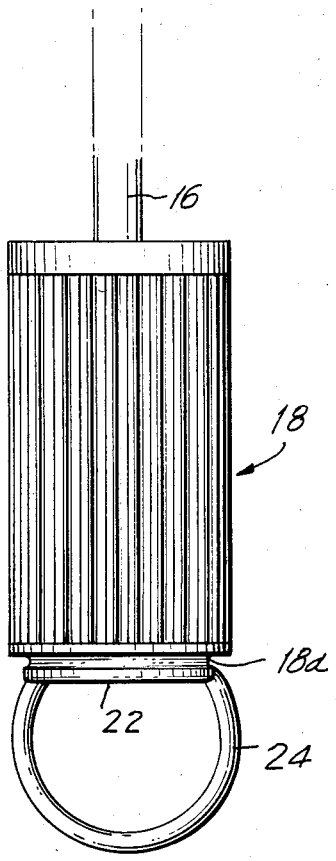
FIG. 5 is a front elevational view thereof.

Referring to FIG. 1 the umbrella generally indicated at 10 comprises a folding canopy 12, folding ribs 14 supporting the canopy and a center pole 16 having an upper end which supports the ribs and canopy. An elongated handle 18 is secured to the lower end of center pole 16 to extend downwardly therefrom and substantially therewith. Of course, the directional terms refer to the upright orientation in which umbrella 10 is shown in FIG. 1.

As seen in FIGS. 1–10, handle 18 has a round sidewall 20, with vertical ribs **20*a* to make it less slippery to hold, and a bottom 22, and a C-shaped carrying ring 24 is pivotally secured to the lower end of handle 18 to move between a closed and snap-locked position (see FIG. 7) and an open position (see FIGS. 3–6). When in the closed position, ring 24 is substantially coaxial with handle 28 (and pole 26) and a substantial portion of the ring arc is substantially flush with the handle sidewall, but a portion of the ring extends radially outwardly of the handle circumference, for the reasons discussed in more detail below. As best seen in FIG. 8, the lower portion of the arc of ring 24 (the portion which starts at point 24*a* and extends counterclockwise up to about point 24*b*) is substantially flush with sidewall 20 of handle 18, while in moving further counterclockwise from point 24*b* the arc of ring 24 start to extend radially outwardly of handle sidewall 20. The bent-in free ends 24*c* and 24*d* of ring 24 are received in respective wells 18*a* and 18*b* in handle 18. The wells face in opposite directions and are substantially coaxial with pivot axis 24*e* of ring 24. They receive the ends of ring 24 freely and allow them rotational motion about pivot axis 24*e* as well as linear motion, at least for free end 24*c*, along pivot axis 24*e*. A circumferential flange 18*c* at the bottom of handle 18 defines a C-shaped circumferential groove 18*d* which is substantially coaxial with handle 18 and matches the outline of ring 24 and receives a substantial portion of the ring arc, but not the entire arc, when ring 24 is in its closed position. Ring 24 and flange 18*c* are shaped and dimensioned such that substantially less than the entire arc of ring 24 makes contact with flange 18*c* when ring 24** is moved into or away from its closed position.

Figure 7:
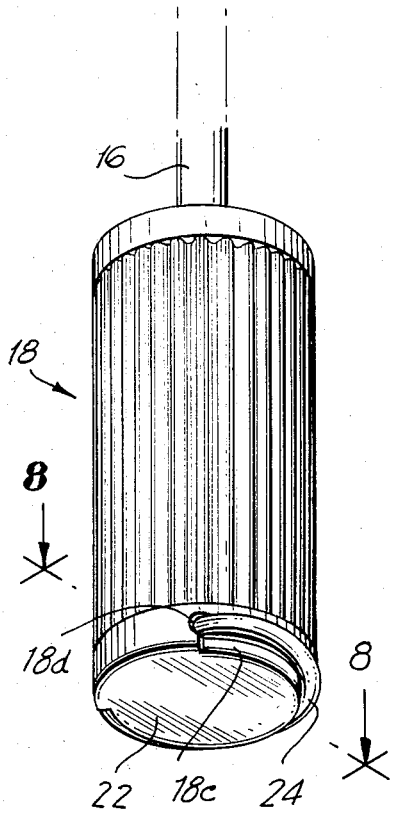
FIG. 7 is a perspective view of the handle showing the ring in its closed position.
Figure 6:
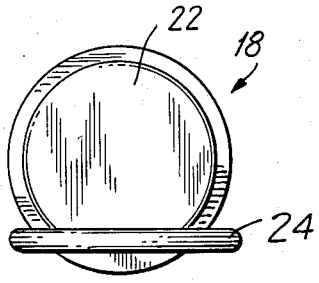
FIG. 6 is a bottom plan view thereof.

In operation, umbrella 10 can be used with ring 24 in its closed position, as illustrated in FIGS. 1, 7 and 8.

When desired, ring 24 can be moved to its open position by pressing down (referring to the handle orientation shown in FIGS. 1 and 7) on ring 24 to snap it over flange 18*c* by forcing ring 24 to open its free ends slightly, typically by having free end 24*c* slide in well 18*a* in the direction designated "a" in FIG. 8. Once ring 24 has cleared flange 18 in its downward pivotal motion, it can be left at any convenient angle of its axis to that of handle 18. This angle can vary from the few degrees when ring 24 has just cleared flange 18*c*, to the about 90° angle which exists when ring 24 is in its open position shown in FIGS. 3 and 4, and it can even be at angles such as illustrated at 24 in FIG. 9. To bring ring 24 back to its closed position, it is pivoted up (again referring to the handle orientation shown in FIGS. 1 and 7) and is forced over flange 18*c* and into groove 18*d*, to snap-lock it into its closed position.

We claim:

1. An umbrella with an elongated round handle having at its bottom end a C-shaped carrying ring which pivots between open and closed positions, snap-locks in the closed position, and is substantially when closed but has a portion which extends radially just beyond the handle outline to facilitate snapping the ring away from its closed position, comprising:

an umbrella body including a folding canopy, folding ribs supporting the canopy and a center pole having an upper end which supports the ribs and canopy;

an elongated handle having a round sidewall and a bottom, said handle being secured to the lower end of the center pole to extend downwardly therefrom and substantially coaxially therewith, a C-shaped ring having bent-in free ends, and means for pivotally securing the ring to the lower end of the handle, and abutting means for limiting the pivotal range of the ring, whereby said ring is manually movable between a closed position, in which the ring is substantially coaxial with the handle and a substantial portion of the ring arc is substantially flush with the handle sidewall but a portion of the ring extends radially outwardly of the handle sidewall, and an open position, in which the ring axis ranges from being about parallel to being about perpendicular to the handle axis;

said means for pivotally securing the ring to the handle comprising a pair of oppositely facing wells which are defined adjacent the handle bottom portion, said bottom portion being integrally formed, said wells being substantially coaxial with the axis of the bent-in free ends of the C-shaped ring and being shaped and dimensioned to receive freely the bent-in ends of the C-shaped ring and to allow rotational motion of said bent-in ends within the wells as the ring pivots about said pivot axis and linear motion thereof along the well axis when the bent-in ends of the ring are forced apart to increase the ring diameter, wherein said pivot axis is immediately adjacent a tangent to the handle sidewall and is offset from the handle axis;

snap-locking means comprising a circumferential flange at the bottom of the handle defining a C-shaped circumferential groove which is substantially coaxial with the handle and matches the outline of the C-shaped ring and receives a substantial portion of the ring arc, but not the entire arc, to make the ring outline substantially flush with the handle sidewall, when the ring is in its closed position; and said ring and snap-locking means being shaped and dimensioned to cause substantially less than the entire arc of the ring to make contact with the flange when the ring is being moved into or away from the closed position, and to cause a portion of the ring arc to extend radially outwardly of the handle sidewall when the ring is in the closed position, to thereby facilitate moving the ring from its closed to its open position by pushing down on the portion thereof which extends beyond the handle while retaining the appearance that the ring in the closed position is substantially flush with the handle sidewall.

2. An umbrella with a handle as in claim 1 in which the handle circumference is circular and the ring arc is substantially but not completely circular and, while substantially coaxial with the handle axis, is sufficiently offset therefrom to cause one side of the ring arc to be flush with the handle sidewall and another side to extend radially outwardly of the sidewall by a distance sufficient to allow snapping the ring out of its closed position by acting on the extending portion along a force vector which is coaxial with and substantially tangential to the circular cross-section of the handle but is insufficient to change the overall visual appearance that the ring in its closed position is substantially flush with said sidewall.

* * * * *